US005185998A

United States Patent [19]

Brew

[11] Patent Number: 5,185,998

[45] Date of Patent: Feb. 16, 1993

[54] CATALYTIC CONVERTER ACCESSORY APPARATUS

[76] Inventor: Kenneth Brew, 127 Goff Rd., Corning, N.Y. 14830

[21] Appl. No.: 866,625

[22] Filed: Apr. 10, 1992

[51] Int. Cl.[5] ..... F01N 3/28

[52] U.S. Cl. ..... 60/299; 422/176

[58] Field of Search ..... 60/299; 422/176, 180

[56] References Cited

FOREIGN PATENT DOCUMENTS 13815 2/1979 Japan ..... 422/176

*Primary Examiner*—Douglas Hart
*Attorney, Agent, or Firm*—Salzman & Levy

[57] ABSTRACT

The present invention features an automotive catalytic converter accessory device for improving the converter's efficiency and operational life. The accessory device has a housing disposed in the manifold exhaust pipe, upstream of the catalytic converter. The housing contains a hollow conduit that conveys the exhaust gases of the manifold to the entrance or interface of the catalytic converter. The conduit has a diffuser portion having a baffle plate disposed at the downstream end thereof, just before the converter inlet. The flow is divided into a bifurcated stream of gases that passes through the baffle plate. The outer stream of exhaust gas is caused to swirl as it passes through slots disposed at the end of the conduit ahead of the baffle plate. The major portion of the exhaust stream is caused to pass through a large central aperture in the baffle plate, along with the outer, swirling stream. This major portion of the exhaust stream maintains a substantially linear flow, thus reducing back pressure and turbulence in the overall flow. The gas entering the catalytic converter bathes the entire substrate due to both the diffusion and the swirling action of part of the exhaust flow. The outer swirling portion of the exhaust stream expands into the wider converter cavity to bathe the outer portions of the substrate. The inner, linear portion of the exhaust stream entering the converter cavity bathes the central, or inner, portion of the substrate. Thus, the entire catalytic substrate is bathed by the exhaust gases entering the converter chamber.

11 Claims, 5 Drawing Sheets

CATALYTIC CONVERTER ACCESSORY APPARATUS

FIELD OF THE INVENTION

The invention relates to catalytic conversion of automobile exhaust gases, and, more particularly, to an accessory apparatus for uniformly distributing the exhaust gases flowing from the manifold exhaust pipe into the catalytic converter, so that substantially all of the catalytic surface area of the converter is uniformly bathed by the flowing exhaust stream.

BACKGROUND OF THE INVENTION

Current automotive catalytic converter devices comprise a multichannel substrate having flow-through channels which are coated with noble metal catalyst materials that convert the pollutant exhaust gases to harmless effluent.

The automotive catalytic converters generally comprise a large, oval-shaped ceramic substrate housed in a metal sleeve or can. The converters connect directly to a manifold exhaust pipe and normally discharge the purified gases into a muffler.

Exhaust gases entering the catalytic converter unit from the manifold exhaust pipe are usually quite specifically directed in their flow. The gas flow tends to concentrate in the middle portion of the ceramic substrate, thus substantially avoiding the outer one-third of the substrate. This is a result of the narrow exhaust pipe cross-section that feeds directly into the larger cross-sectional area of the substrate. The gases from the smaller exhaust pipe do not have a chance to radially diffuse as they enter the converter; thus, most of the exhaust gases flow down the middle of the substrate.

The result of this non-uniform bathing of the converter substrate is that, not only is the converter inefficient, but its operational life is also limited.

It is common with some catalytic converter systems that air is injected into the longitudinal mid-portion thereof in order to reduce the oxides of nitrogen emissions that are present in the exhaust gases. This procedure is also an inefficient use of converter substrate, since only a downstream portion of the substrate is provided with the oxygen-enriched effluent.

The present invention provides an apparatus at the inlet of the converter that will more uniformly bathe the substrate with exhaust gases. The apparatus is designed to provide the uniform bathing in an efficient manner, so that back pressure and turbulence in the exhaust conduit are minimized. The apparatus has a simple, integral construction, making the device inexpensive to both fabricate and install.

The subject catalytic converter accessory of this invention uses a dynamic exhaust gas mixture to bathe the catalytic converter substrate. This dynamic exhaust gas mixture comprises a bifurcated flow, comprising a substantially linear mid-portion stream, which is surrounded by an outer, diffuse, swirling stream of gases. The accessory device comprises a diffuser-shaped shell which has a barrier plate disposed in a mid-portion thereof. The device is installed at the exhaust pipe/converter interface.

The invention at hand reduces both turbulence and back pressure in the exhaust gas flow in three ways:

(1) The exhaust gases in the exhaust conduit are split into a bifurcated flow stream, in which only an outer portion of the exhaust gas stream is caused to swirl. These swirling outer gases expand into the converter chamber, bathing the outer portions of the catalytic substrate. The remaining mid-portion of the exhaust stream bathes the center of the catalytic substrate. This mid-portion comprises the major portion of the gaseous stream. It is maintained in a substantially linear flow in order to reduce turbulence and back pressure in the overall flow stream;

(2) The exhaust gases are caused to diffuse prior to their bifurcation, thus allowing for a more uniform dispersion as they enter the catalytic converter interface. The diffusion of the outer flow stream portion of the exhaust gas, along with its swirling and expanding action, creates a quite effective and uniform bathing of the outer portions of the catalytic substrate; and (3) The swirling action is caused by a barrier plate disposed at the interface between the diffuser and the catalytic chamber and takes the place of an injected gas stream which is common to other such swirl-making devices. This results in lesser amounts of the turbulence and back pressure that are routinely experienced with the exhaust stream injection method.

DISCUSSION OF RELATED ART

In U.S. Pat. No. 3,964,875, issued to Chang et al, on Jun. 22, 1976, a pinwheel apparatus is provided ahead of the converter for the purpose of directing the exhaust gas effluent to the outer portions of the converter substrate. While this apparatus is successful in eliminating the partial, center bathing of the catalytic substrate, it does not provide a uniform distribution of the exhaust gases. The velocity profile of the resultant flow stream clearly indicates that this device is directing more gaseous products to the outer portions of the substrate at the expense of the mid-portion.

In U.S. Pat. No. 4,209,495, issued on Jun. 24, 1980, to Kobayashi et al, a device similar to the apparatus of the aforementioned Chang et al is shown. In this apparatus, the exhaust flow is directed by a number of different, internal vanes or guide projections. This device also illustrates a diffuser cone positioned ahead of the converter in order to more uniformly bathe the catalytic substrate. While these various embodiments will direct the gas flow to the peripheral portions of the converter, there is no teaching or suggestion that any of these systems will provide a more uniform gas distribution. In other words, it is not demonstrated that the velocity profile is sufficiently flattened to provide a uniform bathing of the entire substrate cross-section.

In the combined diffusing cone and diverter apparatus illustrated in U.S. Pat. No. 4,783,959, issued to Sickels on Nov. 15, 1988, an attempt is made to provide a linear gas flow cross-section for the exhaust gas. While such a flow tends to flatten the distribution of the gases across the substrate interface, there is little benefit provided in reducing back pressure losses.

In the Japanese Patent Application No. 52-62659, published on Dec. 12, 1978, for a CATALYZER SYSTEM EXHAUST GAS PURIFIER, by Akio Nara, a device for inducing a swirling action into an exhaust stream ahead of the catalytic converter is illustrated. This system introduces a side injection of gas into the main stream of the exhaust conduit in order to cause a swirling of the exhaust gases as they enter the converter interface.

In contrast, the catalytic converter accessory apparatus of the present invention causes a swirling action in the exhaust gases which are introduced to the converter, thus obviating the need to introduce additional gas into the flow stream. This invention provides a simple construction, which reduces cost and minimizes both turbulence and back pressure in the line. The invention achieves a swirling of only a portion of the gases. The major portion of the inventive exhaust stream is maintained in substantially linear flow, thus, reducing the back pressure and turbulence that generally accompany the introduction of external gaseous components.

SUMMARY OF THE INVENTION

In accordance with the present invention, there is provided an automotive catalytic converter accessory device for improving the converter's efficiency and operational life. The accessory device comprises a housing disposed in the manifold exhaust pipe, upstream of the catalytic converter. The housing contains a hollow conduit that conveys the exhaust gases of the manifold to the entrance or interface of the catalytic converter. The conduit comprises a diffuser portion having a baffle plate disposed at the downstream end thereof, just before the converter inlet. The flow is divided into a bifurcated stream of gases that passes through the baffle plate. The outer stream of exhaust gas is caused to swirl as it passes through slots disposed at the end of the conduit ahead of the baffle plate. The major portion of the exhaust stream is caused to pass through a large central aperture in the baffle plate, along with the outer, swirling stream. This major portion of the exhaust stream maintains a substantially linear flow, thus reducing back pressure and turbulence in the overall flow. The gas entering the catalytic converter bathes the entire substrate due to both the diffusion and the swirling action of part of the exhaust flow. The outer swirling portion of the exhaust stream expands into the wider converter cavity to bathe the outer portions of the substrate. The inner, linear portion of the exhaust stream entering the converter cavity bathes the central, or inner, portion of the substrate. Thus, the entire catalytic substrate is bathed by the exhaust gases entering the converter chamber.

It is an object of the present invention to provide an improved catalytic converter system.

Another object of this invention is to provide an accessory apparatus to be used in conjunction with an automotive catalytic converter to more efficiently catalyze the exhaust gases, while minimizing turbulence and back pressure in the exhaust manifold.

It is a further object of the invention to provide a catalytic converter system in which the catalytic substrate is substantially uniformly bathed by the exhaust gases.

BRIEF DESCRIPTION OF THE DRAWINGS

A complete understanding of the present invention may be obtained by reference to the accompanying drawings, when considered in conjunction with the subsequent, detailed description, in which.

For purposes of brevity and clarity, like elements and components will bear the same designation throughout the FIGURES.

DESCRIPTION OF THE PREFERRED EMBODIMENT

This invention features an accessory apparatus for use in an automotive catalytic converter system. The accessory apparatus provides for uniformly bathing the catalytic substrate of the converter with exhaust gas. The uniform bathing of the catalyst surfaces of the converter substrate makes for a more efficient use of the converter substrate and extends its operational life. The accessory device works upon a dynamic flow principle, wherein the exhaust gases are divided into bifurcated (split) flow streams. A major portion of the exhaust gases resides in a first, centrally-positioned flow stream. This flow stream comprises a substantially linear flow, in which the overall exhaust conduit experiences little turbulence and back pressure. The first stream bathes the mid-portions of the substrate upon entering the catalytic converter. The second portion of the flow resides in an outer exhaust flow stream that has been caused to diffuse, swirl and expand about the first flow stream. These swirling gases entering the catalytic converter cavity expand by centrifugal force and a diffusing action to fill the outer sections of the converter cavity. Hence, these gases uniformly bathe the remaining outer catalytic substrate portions not reached by the first flow stream.

Figure 1:
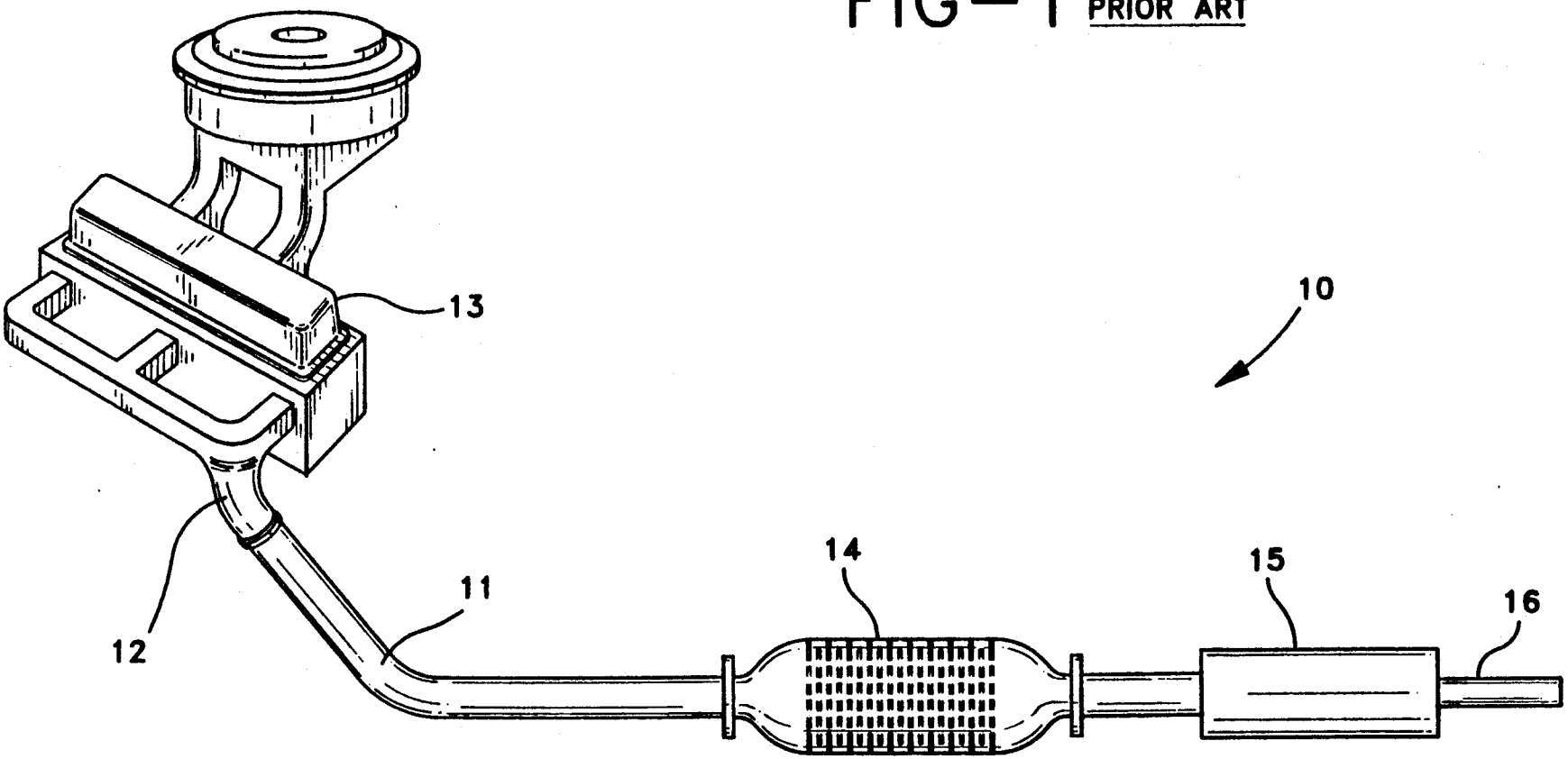
FIG-1 PRIOR ART
FIG. 1 is a schematic perspective view of the prior art catalytic converter exhaust system of an automobile.

Now referring to FIG. 1, a typical, prior art exhaust system 10 is illustrated. The system 10 comprises a manifold exhaust pipe 11 carrying the exhaust gases from the manifold 12 of engine 13. The exhaust gases flow into a catalytic converter 14, where the pollutants in the combusted gases are converted to harmless substances. From the converter 14, the effluent travels to the muffler 15, and thereafter is exhausted into the atmosphere through the tail pipe 16.

The gases entering the converter 14 are narrowly directed thereinto through the smaller-sized manifold exhaust pipe 11, so that only a small portion of the substrate 30 is bathed in the exhaust effluent. That is, only the central portion of the substrate receives the exhaust gases, while the outer portions of the substrate go unbathed. This is a very inefficient use of the substrate and results in a shortened operating life of the converter.

Figure 2:
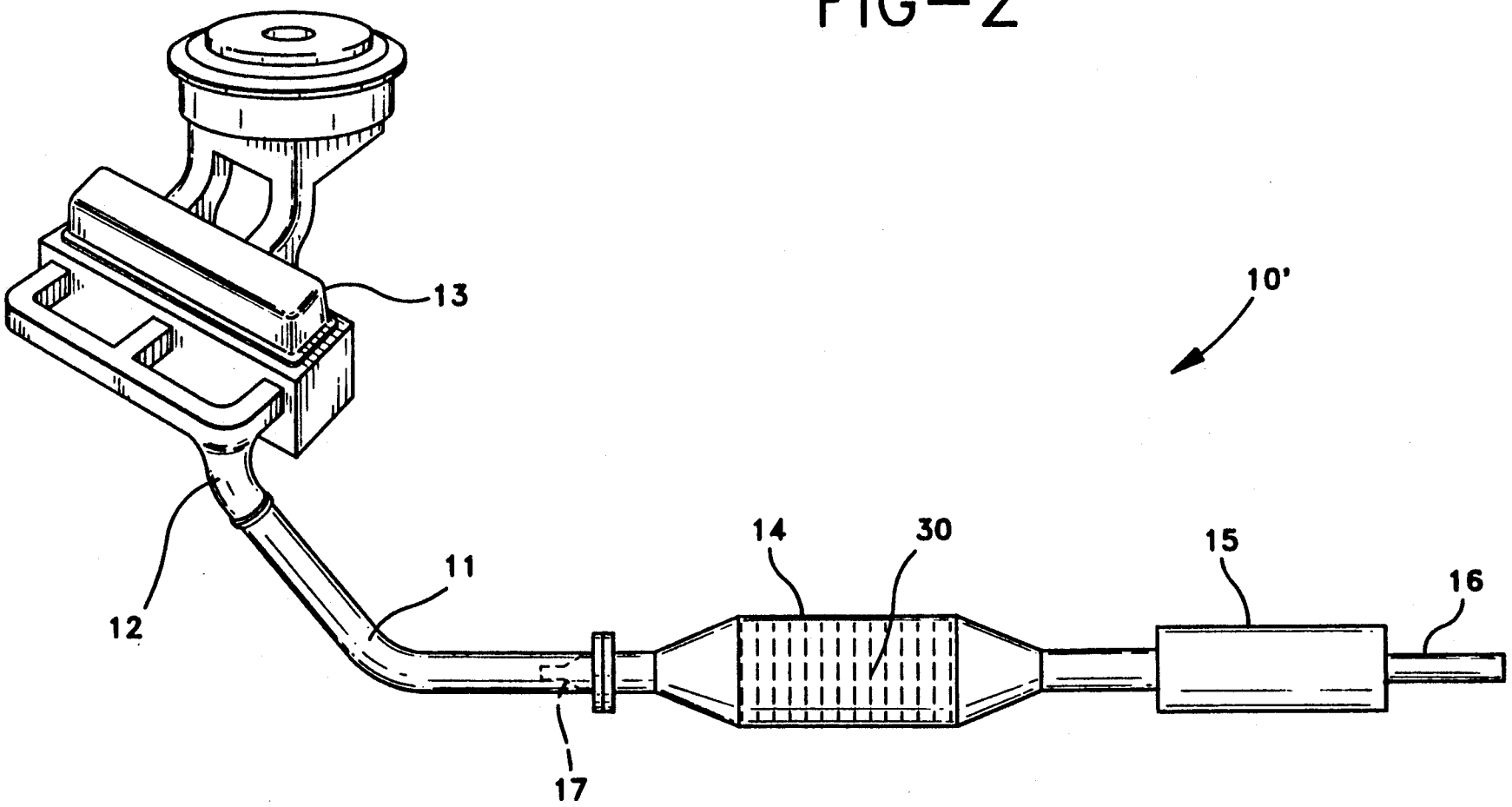
FIG. 2 is a schematic perspective view of the automotive catalytic converter exhaust system of the invention featuring the accessory device for uniformly bathing the substrate of the catalytic converter with exhaust gases.

Referring to FIG. 2, a modified exhaust system 10' is shown, having an accessory device 17 disposed within the manifold exhaust pipe 11, adjacent the inlet of the catalytic converter 14. The gases flowing through the manifold exhaust pipe 11 (arrow 20) feed into the accessory device 17 on their way to converter 14.

Figure 3:
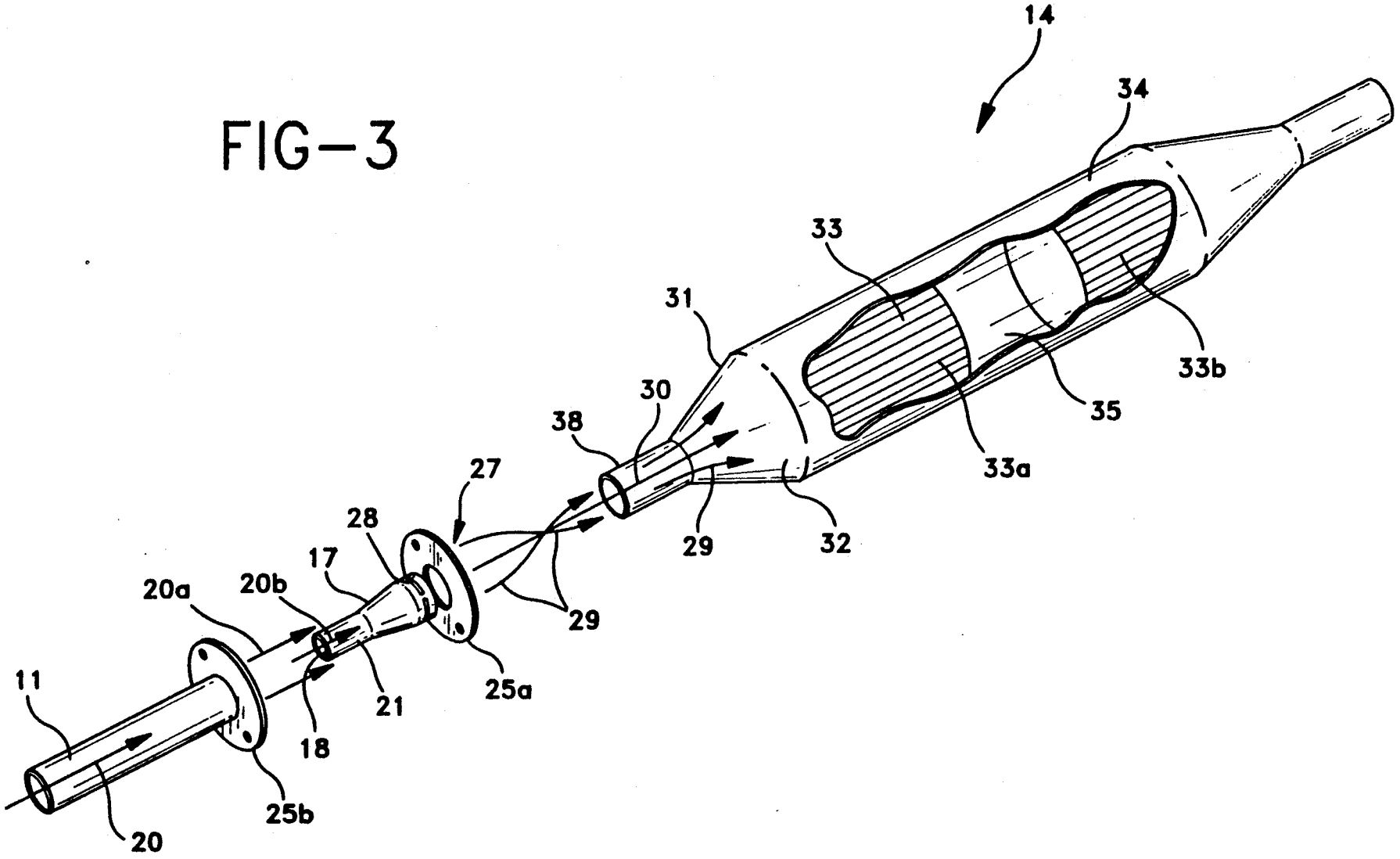
FIG. 3 is a partially exploded view of the converter and exhaust accessory device of this invention, in accordance with FIG. 2.

Referring to FIG. 3, the accessory device 17 and catalytic converter 14 are shown in a partially exploded view in order to reveal more details of their construction and operation. The accessory device 17 is slipped within exhaust pipe 11 and bolted thereto by means of two bolts (not shown) passing through respective bolt holes 26*a* and 26*b*, disposed in mating flanges 25*a* and 25*b*, respectively, of a barrier or baffle plate 19, and illustrated in greater detail in FIG. 4.

The exhaust gases flow (arrow 20) from the manifold exhaust pipe 11 into the accessory device 17, which is disposed within the exhaust pipe 11, as aforementioned. The gases flowing toward the accessory device 17 are split into two streams, 20*a* and 20*b*, respectively. Flow stream 20*a* flows over the outer surface of device 17, whereas flow stream 20*b* flows into the hollow opening 18 of device 17. The exhaust flow 20*b* entering the opening 18 flows into the chamber 24 of device 17, which is defined by inner wall surfaces 23, as illustrated in FIG. 5. The exhaust flow 20*a* which flows over the outer wall 21 of device 17 and between the outer wall 2 and the inner wall of the exhaust pipe 11 is trapped therebetween. The only path of escape for the exhaust flow gases 20*a* is through a plurality of slots 28 in outer wall 21; this is best visualized by reference to FIGS. 4 and 5. There are four slots 28 disposed about the periphery of outer wall 21 of device 17. The exhaust gases 20*a* flow through slots 28 into chamber 24 and out through the center hole 22 of the barrier or baffle plate 19 at the distal end 27 of chamber 24. The flow 20*b* that enters opening 18 of chamber 24 also flows out of the hole 22 of the baffle plate 19. Thus, the split flow patterns 20*a* and 20*b* now become combined flow patterns, as defined by respective arrows 29 and 30. The original exhaust flow 20*b*, traveling through the center aperture 22 of baffle plate 19, is hence defined by arrow(s) 30. Exhaust flow 30 remains essentially unimpeded and, therefore, maintains a substantially linear flow about the longitudinal axis 26. This flow 3 continues from the distal end 27 of chamber 24 into the inlet 38 of converter 14. It continues into converter cavity 32 (FIG. 5), where it impinges upon and passes through the central portion of substrate 33, as illustrated in FIG. 5.

Exhaust flow 20*a*, passing through slots 21, is traveling at a slower speed than the other flow 20*b* along the longitudinal axis 26. The differential in speed of this flow 20*a*, compared with that of the center flow 20*b*, as well as the configuration of slots 28, causes this flow 20*a* to begin to swirl. The swirling flow is defined by arrows 29. The swirling flow 29 leaves the distal end 27 of the accessory device 17 and enters the inlet 38 of converter 14.

When the swirling gas 29 enters the expanded cone portion 31 of the converter housing 34, the swirling gases will expand outwardly under centrifugal force and the diffusion action created by the cone portion 31. Exhaust flow 29 fills the outer portions of cone cavity 32. This expansion of the gases 29 provides a bathing of the outer substrate portions of catalytic substrate 33. In this fashion, all the catalytically coated surfaces or channels of the catalytic substrate 33 will be fully utilized, thus improving the efficiency of the converter 14.

The substrate 33 in the converter housing 34 is generally separated into two halves, 33*a* and 33*b*, as illustrated in FIG. 3. In many catalytic systems, air is introduced in the mid-portion of housing 34 between the two substrate halves, as depicted by arrow 35. Air is injected in order to convert the toxic nitrogen oxides present in the exhaust gases. This technique is enhanced by the full bathing of the substrates, per the invention.

Figure 4:
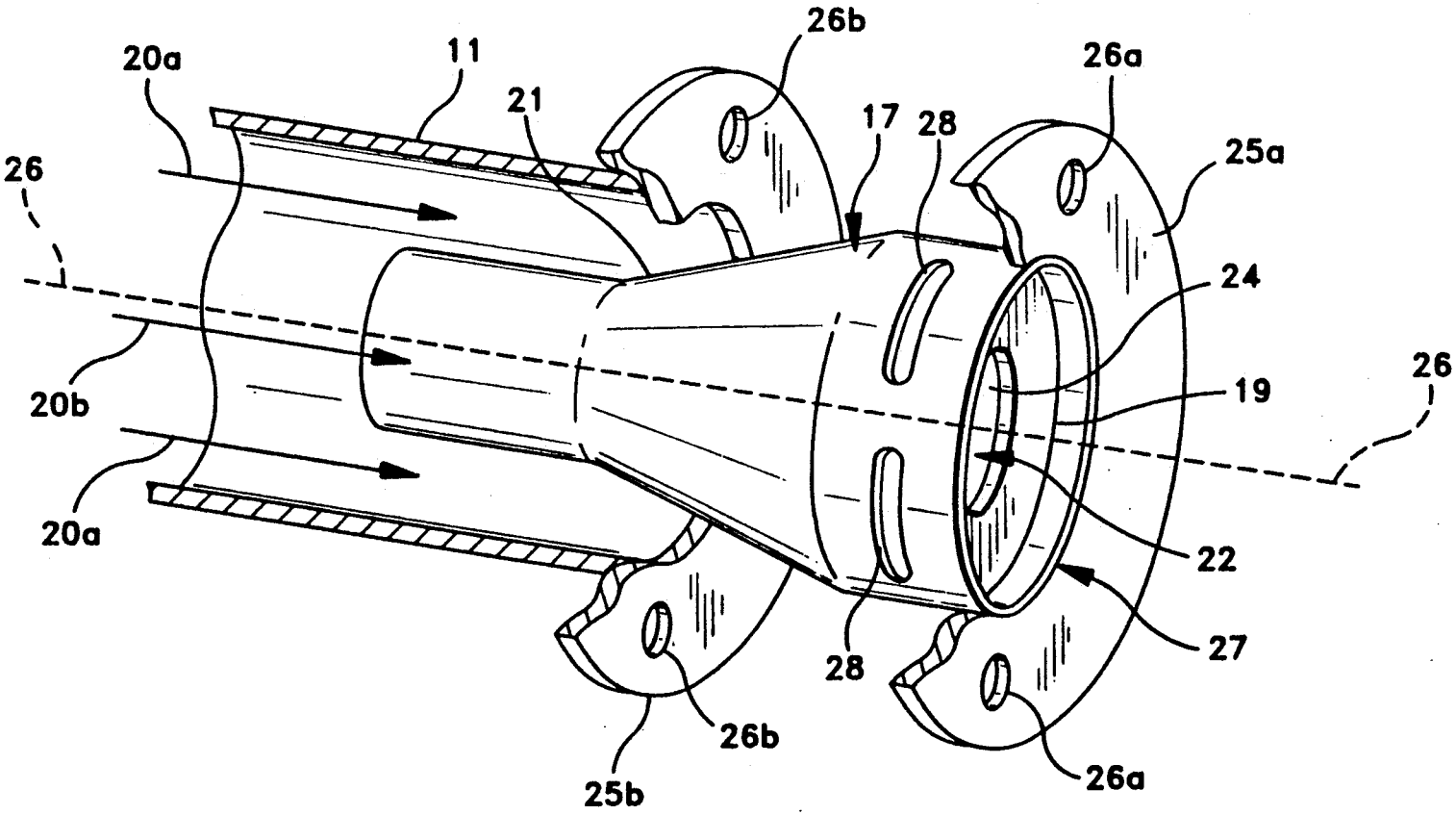
FIG. 4 is a partial, perspective view of the accessory device illustrated in FIG. 3.
Figure 5:
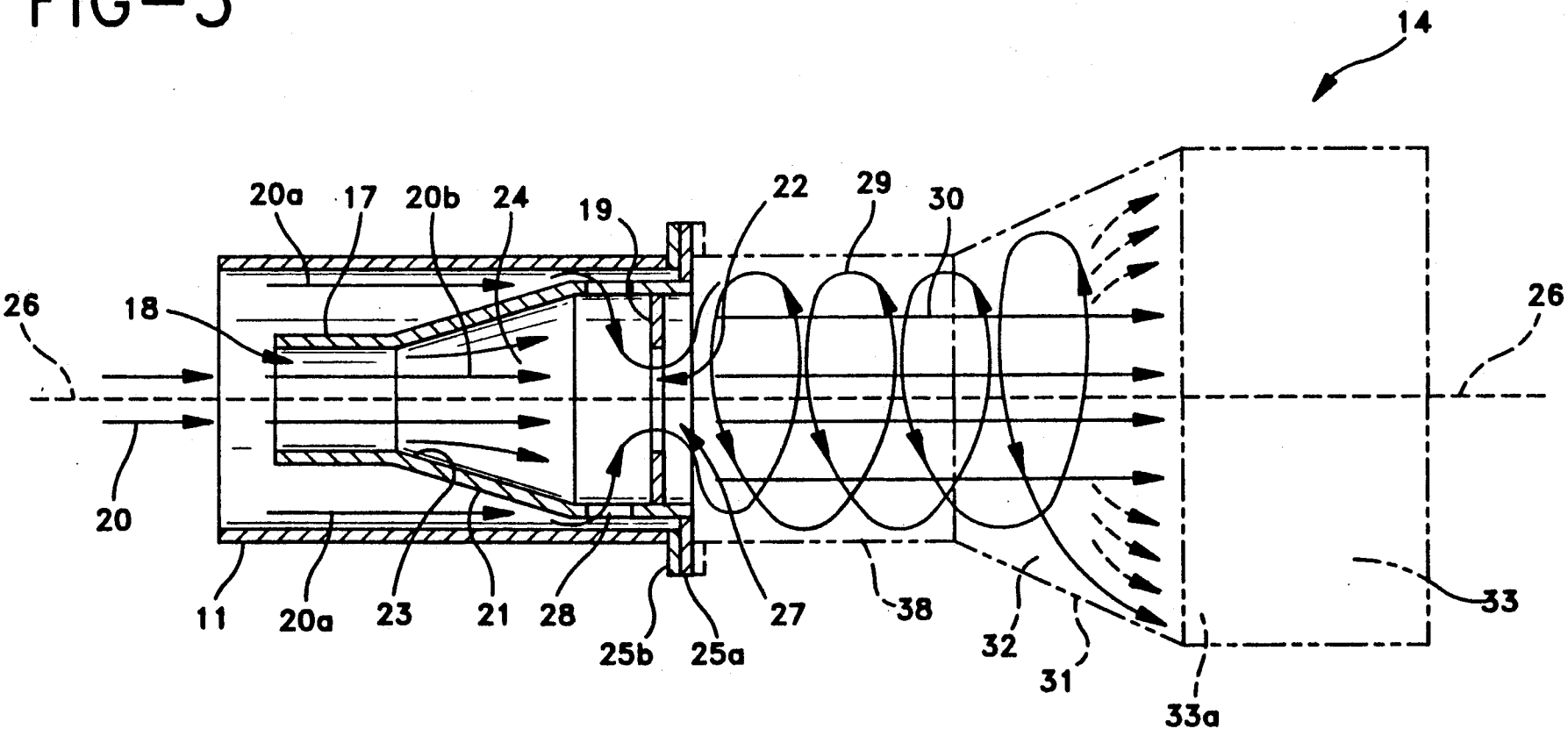
FIG. 5 is an enlarged, sectional, schematic view of air flow through the accessory device and catalytic converter of FIG. 3.

The accessory device 17 of this invention can be easily mounted between exhaust manifold pipe 11 and the inlet 38 of catalytic converter 14, by means of flanges 25*a* and 25*b*, as shown in FIG. 4.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. An exhaust device for use in an automotive catalytic converter system, said exhaust device being disposed between an exhaust manifold and a catalytic converter of the catalytic converter system to provide a substantially uniform bathing of a catalytic substrate of the converter with exhaust gases, said exhaust device comprising:

a housing having an inner chamber for conveying flowing manifold exhaust gases to an inlet portion of a catalytic converter;

means defining an axis of flow within said chamber for conveying said flowing manifold exhaust gases therethrough; and bifurcating means disposed in said chamber of said housing for bifurcating said flowing manifold exhaust gases into two separate flow patterns, a first one of said flow patterns defining gases traveling along and about said axis of flow, and a second one of said flow patterns defining gases that have been caused to swirl and expand, whereby outer portions of a catalytic converter substrate will be bathed by said second one of said flow patterns, said first one and second one of said flow patterns combining to substantially uniformly bathe the substrate of the catalytic converter.

2. The exhaust device of claim 1, wherein said bifurcating means comprises a plurality of slots disposed at a distal end of said chamber.

3. The exhaust device of claim 1, wherein said chamber defines a diffusing means for expanding and slowing a portion of said flowing manifold exhaust gases.

4. The exhaust device of claim 2, wherein said chamber further comprises a baffle plate including means defining a central aperture for passage of gases defined by said first one and second one of said flow patterns.

5. An exhaust device for use in an automotive catalytic converter system, said exhaust device being disposed between an exhaust manifold and a catalytic converter of the catalytic converter system to provide a substantially uniform bathing of a catalytic substrate of the converter with exhaust gases, said exhaust device comprising:

a housing having an inner chamber for conveying flowing manifold exhaust gases to an inlet portion of a catalytic converter;

means defining an axis of flow within said chamber for conveying said flowing manifold exhaust gases therethrough; and dividing means disposed in said chamber for separating said manifold exhaust gas flow into substantially linear and swirling flow patterns with respect to said axis of flow, said dividing means comprising a plurality of apertures disposed at a distal end of said chamber for providing said swirling flow, whereby the manifold exhaust gas defining said swirling flow pattern of exhaust gases will be caused to expand as they enter the inlet portion of said catalytic converter and thereby bathe outer portions of a substrate of the catalytic converter, and said substantially linear flow pattern of manifold exhaust gas will bathe a central portion of said substrate, whereby substantially all of said substrate of the catalytic converter will be bathed by said manifold exhaust gas.

6. The exhaust device of claim 5, wherein said chamber defines a diffusing means for expanding and slowing a portion of said flowing manifold exhaust gases.

7. The exhaust device of claim 6, wherein said chamber comprises a baffle plate including means defining a central aperture for passage of gases defined by said linear and swirling flow patterns.

8. The exhaust device of claim 7, wherein said baffle plate comprises means defining a plurality of peripheral slots for passage of gases defined by said swirling flow patterns.

9. An exhaust device for use in an automotive catalytic converter system, said exhaust device being disposed between an exhaust manifold and a catalytic converter of the catalytic converter system to provide a substantially uniform bathing of a catalytic substrate of the converter with exhaust gases, said exhaust device comprising:

a housing having an inner chamber for conveying flowing manifold exhaust gases to an inlet portion of a catalytic converter, said inner chamber having a diffusing surface for diffusing said flowing manifold exhaust gases;

means defining an axis of flow within said chamber for conveying said flowing manifold exhaust gases therethrough; and dividing means disposed in said chamber for separating said manifold exhaust gas flow into substantially linear and swirling flow patterns with respect to said axis of flow, said dividing means comprising a plurality of apertures disposed at a distal end of said chamber for providing said swirling flow, whereby the manifold exhaust gases defined by said swirling flow pattern of exhaust gases will be caused to expand as they enter the inlet portion of said catalytic converter and thereby bathe outer portions of a substrate of the catalytic converter, and said substantially linear flow pattern of manifold exhaust gas will bathe a central portion of said substrate, whereby substantially all of said substrate of the catalytic converter will be bathed by said manifold exhaust gas.

10. The exhaust device of claim 9, wherein said chamber includes a baffle plate having means defining a central aperture for passage of gases.

11. The exhaust device of claim 10, wherein said chamber comprises means defining a plurality of peripheral slots for passage of gases defined by said swirling flow pattern.

* * * * *